US009481000B2

(12) United States Patent
Wrobel et al.

(10) Patent No.: US 9,481,000 B2
(45) Date of Patent: Nov. 1, 2016

(54) ADJUSTING PUMP FLOW AT TOOL

(75) Inventors: Steve J. Wrobel, Rogers, MN (US); Jeromy D. Horning, Albertville, MN (US); Robert J. Gundersen, Otsego, MN (US); James M. Dalton, Elk River, MN (US); Christopher A. Lins, Crystal, MN (US); Grant E. Kurre, Corcoran, MN (US)

(73) Assignees: Graco Minnesota Inc., Minneapolis, MN (US); Axia Acquistion Corporation, Stone Mountain, GA (US)

( * ) Notice: Subject to any disclaimer, the term of this patent is extended or adjusted under 35 U.S.C. 154(b) by 0 days.

(21) Appl. No.: 13/635,654

(22) PCT Filed: Mar. 16, 2011

(86) PCT No.: PCT/US2011/028653

§ 371 (c)(1),
(2), (4) Date: Sep. 17, 2012

(87) PCT Pub. No.: WO2011/116084

PCT Pub. Date: Sep. 22, 2011

(65) Prior Publication Data

US 2013/0008536 A1 Jan. 10, 2013

Related U.S. Application Data

(60) Provisional application No. 61/315,322, filed on Mar. 18, 2010.

(51) Int. Cl.
*B65D 88/54* (2006.01)
*B05B 12/00* (2006.01)
(Continued)

(52) U.S. Cl.
CPC ..... *B05B 12/00* (2013.01); *E04F 21/12* (2013.01); *B05B 7/2489* (2013.01); *B05B 12/002* (2013.01); *Y10T 137/85978* (2015.04)

(58) Field of Classification Search
CPC ..... B05B 12/00; F04B 49/20; F04B 17/03; F04D 13/06; F04D 15/0066; B05C 17/002
USPC ..... 222/52, 63, 75, 333; 417/44.1, 326, 42; 239/332
See application file for complete search history.

(56) References Cited

U.S. PATENT DOCUMENTS 506,708 A * 10/1893 Middleton ..... 222/175
1,829,479 A * 10/1931 Elkins ..... 425/87
(Continued)

FOREIGN PATENT DOCUMENTS

CN 1272807 A 11/2000

OTHER PUBLICATIONS

Graco Inc Parts List for Ultra® Platinum sprayers, 2008 revision date, showing remote switch that attaches to hose (see p. 8) to control flow rate.

(Continued)

*Primary Examiner* — Patrick M Buechner
*Assistant Examiner* — Randall Gruby
(74) *Attorney, Agent, or Firm* — Kinney & Lange, P.A.

(57) ABSTRACT

A pump 24 with speed control is utilized. A dispenser 12 may have a trigger 14 which actuates a valve 16. Dispenser control 18 has "up" and "down" buttons, 20 and 22 respectively. The controls 28(comprising elements 18, 20 and 22) for the pump 24 are remote from pump 24. The controls communicate with the pump via wires or radio frequency (RF) 26 to regulate pump speed. Quick button (20 and 22) presses will incrementally change the flow setting while long button (20 and 22) presses will change the settings at a higher rate. This control method can also be tied to the controls located on the pump 24. The potentiometer 30 on the pump 24 will set a max setting, and any adjustments at the valve can go below this setting and back up to it, but never exceed it.

1 Claim, 1 Drawing Sheet

(51) Int. Cl.

| | |
|---|---|
| ***E04F 21/12*** | (2006.01) |
| *B05B 7/24* | (2006.01) |

(56) References Cited

U.S. PATENT DOCUMENTS

| | | | | | |
|---|---|---|---|---|---|
| 2,700,535 | A * | 1/1955 | Harrington et al. | 366/11 |
| 3,322,350 | A | 5/1967 | Heinicke et al. | |
| 3,455,507 | A * | 7/1969 | Brouwer et al. | 239/215 |
| 3,457,017 | A * | 7/1969 | Bastian | 401/146 |
| 3,549,267 | A * | 12/1970 | Dohle et al. | 401/147 |
| 3,622,130 | A * | 11/1971 | Malm | 366/4 |
| 3,974,879 | A * | 8/1976 | Nelson et al. | 169/43 |
| 4,175,300 | A * | 11/1979 | McGlew et al. | 15/103.5 |
| 4,332,498 | A * | 6/1982 | Lewis | 401/188 R |
| 4,389,886 | A * | 6/1983 | Korczak | 73/168 |
| 4,422,789 | A * | 12/1983 | Charney et al. | 401/218 |
| 4,424,011 | A * | 1/1984 | O'Brien et al. | 417/477.8 |
| 4,537,522 | A * | 8/1985 | Charney et al. | 401/218 |
| 4,576,553 | A * | 3/1986 | Winston et al. | 417/9 |
| 4,588,318 | A | 5/1986 | O'Brien et al. | |
| 4,609,148 | A * | 9/1986 | Gill | 239/224 |
| 4,621,770 | A * | 11/1986 | Sayen | 239/304 |
| 4,661,045 | A * | 4/1987 | Winston et al. | 417/9 |
| 4,717,276 | A * | 1/1988 | O'Brien et al. | 401/197 |
| 4,819,842 | A * | 4/1989 | Westervelt | 222/642 |
| 4,965,894 | A * | 10/1990 | Baus | 4/605 |
| 5,022,864 | A * | 6/1991 | Ali | 439/192 |
| 5,201,023 | A * | 4/1993 | Motzko | 388/824 |
| 5,207,381 | A * | 5/1993 | Gill | 239/72 |
| 5,351,903 | A * | 10/1994 | Mazakas et al. | 239/705 |
| 5,381,962 | A * | 1/1995 | Teague | 239/526 |
| 5,383,605 | A | 1/1995 | Teague | |
| 5,415,349 | A * | 5/1995 | Gill | 239/222.11 |
| 5,503,880 | A * | 4/1996 | Matschke | 427/475 |
| 5,878,921 | A * | 3/1999 | Chase et al. | 222/333 |
| 6,053,365 | A * | 4/2000 | O'Mara et al. | 222/148 |
| 6,102,665 | A * | 8/2000 | Centers | F04B 49/10 417/17 |
| 6,154,355 | A * | 11/2000 | Altenburger et al. | 361/191 |
| 6,217,328 | B1 * | 4/2001 | Oliver | 433/80 |
| 6,299,035 | B1 * | 10/2001 | Dalhart | 222/505 |
| 6,388,642 | B1 * | 5/2002 | Cotis | G06F 3/0489 345/33 |
| 6,500,262 | B1 * | 12/2002 | Bednarz et al. | 118/696 |
| 6,530,750 | B2 * | 3/2003 | Mills | 417/26 |
| 6,557,789 | B1 | 5/2003 | Haas | |
| 6,565,252 | B2 * | 5/2003 | Dillinger et al. | 366/13 |
| 6,592,336 | B1 * | 7/2003 | Hirano et al. | 417/201 |
| 6,659,306 | B2 * | 12/2003 | Boyle et al. | 222/1 |
| 6,796,964 | B2 * | 9/2004 | Eidson et al. | 604/135 |
| 7,320,437 | B2 * | 1/2008 | Anderson et al. | 239/154 |
| 7,503,338 | B2 * | 3/2009 | Harrington et al. | 137/355.2 |
| 8,043,070 | B2 * | 10/2011 | Stiles et al. | 417/44.1 |
| 8,465,262 | B2 * | 6/2013 | Stiles et al. | 417/44.1 |
| 8,596,898 | B2 * | 12/2013 | Walcot et al. | 401/218 |
| 8,845,222 | B2 * | 9/2014 | Frank et al. | 401/197 |
| 2001/0003563 | A1 | 6/2001 | Schauer et al. | |
| 2002/0028103 | A1 * | 3/2002 | Frank et al. | 401/197 |
| 2004/0011886 | A1 | 1/2004 | Lawson et al. | |
| 2004/0133165 | A1 * | 7/2004 | Duchon et al. | 604/151 |
| 2005/0156060 | A1 * | 7/2005 | Attar | 239/332 |
| 2005/0232684 | A1 * | 10/2005 | Giacomo | 401/136 |
| 2005/0279865 | A1 | 12/2005 | Thomason et al. | |
| 2007/0154323 | A1 * | 7/2007 | Stiles et al. | 417/44.1 |
| 2007/0209586 | A1 * | 9/2007 | Ebensberger et al. | 118/682 |
| 2007/0272707 | A1 | 11/2007 | Peralta et al. | |
| 2008/0011877 | A1 | 1/2008 | Hibbard et al. | |
| 2008/0065001 | A1 * | 3/2008 | DiNucci et al. | 604/19 |
| 2008/0132763 | A1 * | 6/2008 | Isaacson | 600/158 |
| 2008/0251607 | A1 | 10/2008 | Krayer et al. | |
| 2009/0110839 | A1 | 4/2009 | Mather et al. | |
| 2009/0149743 | A1 * | 6/2009 | Barron et al. | 600/431 |
| 2010/0010524 | A1 * | 1/2010 | Barrington et al. | 606/167 |
| 2010/0100075 | A1 * | 4/2010 | Weston et al. | 604/543 |
| 2010/0228273 | A1 * | 9/2010 | Staid et al. | 606/167 |
| 2010/0308963 | A1 * | 12/2010 | Kidd et al. | 340/5.85 |
| 2010/0310382 | A1 * | 12/2010 | Kidd et al. | 417/12 |
| 2012/0090337 | A1 * | 4/2012 | Chen et al. | 62/79 |
| 2012/0187217 | A1 * | 7/2012 | Maget et al. | 239/326 |
| 2012/0289891 | A1 * | 11/2012 | Abdulreda et al. | 604/28 |
| 2013/0008536 | A1 * | 1/2013 | Wrobel et al. | 137/565.01 |
| 2013/0011176 | A1 * | 1/2013 | Horning et al. | 401/143 |
| 2013/0251542 | A1 * | 9/2013 | Stiles et al. | 417/44.1 |
| 2014/0008383 | A1 * | 1/2014 | Mergener et al. | 222/1 |
| 2014/0084025 | A1 * | 3/2014 | Tix et al. | 222/135 |
| 2014/0286793 | A1 * | 9/2014 | Suzuki et al. | 417/26 |
| 2014/0334941 | A1 * | 11/2014 | Wada et al. | 417/42 |
| 2015/0147191 | A1 * | 5/2015 | Heathcoat et al. | 417/45 |

OTHER PUBLICATIONS

Graco Inc. Operation manual for HTX 2030, Jul. 2009 revision, example of on/off switch on p. 7 and 9. Some pumps use this type of switch to control power.

The State Intellectual Property Office of the People's Republic of China, First Office Action, Application No. 201180014666.7, dated Oct. 8, 2014, 8 pages.

* cited by examiner

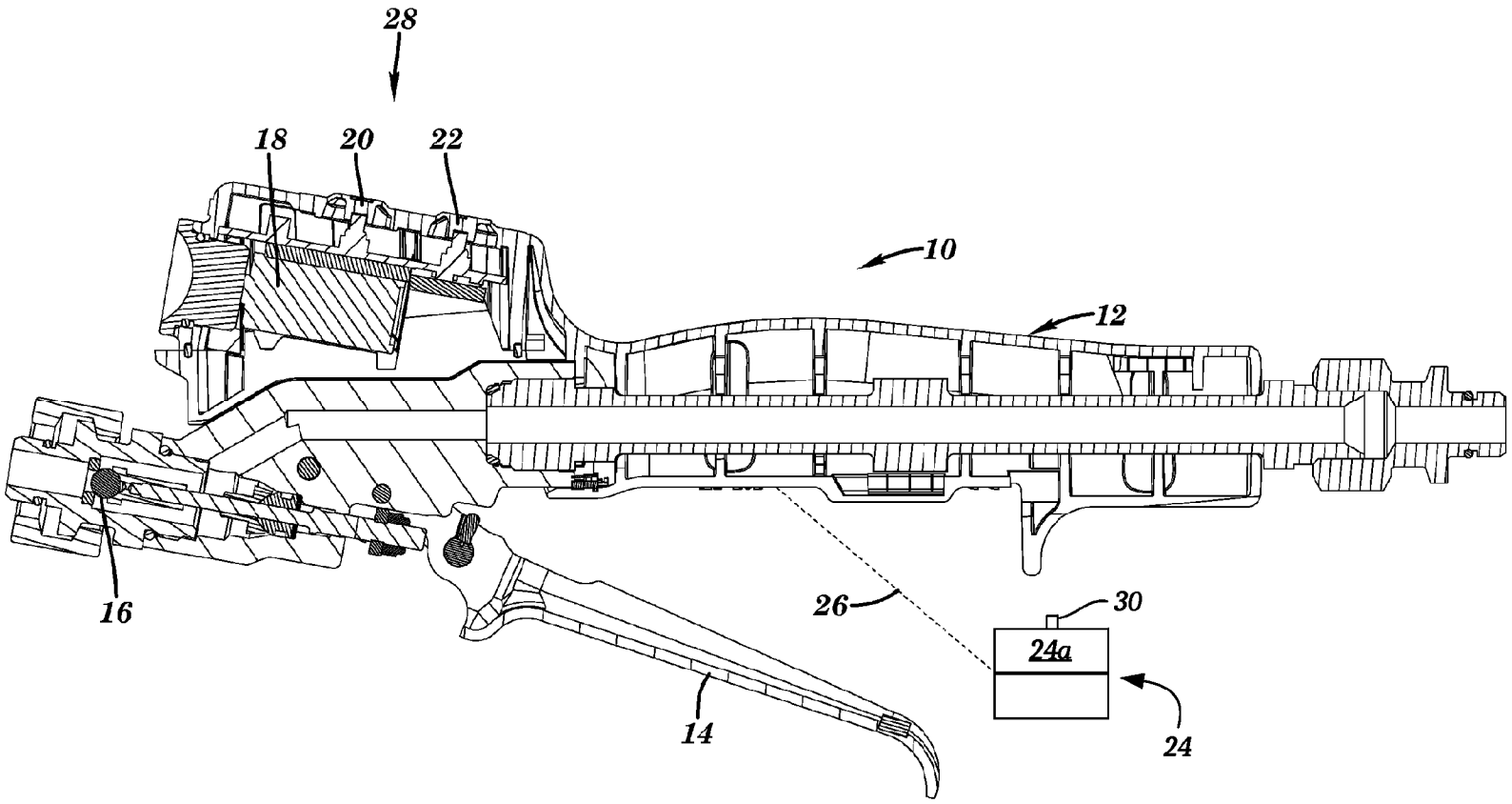
10
12
14
16
18
20
22
24
24a
26
28
30

ADJUSTING PUMP FLOW AT TOOL

TECHNICAL FIELD

This application claims the benefit of U.S. Application Ser. No. 61/315,322, filed Mar. 18, 2010, the contents of which are hereby incorporated by reference.

SUMMARY

It is an object of this invention to be able to adjust pump speed from a location remote from the pump. Such pumps may typically be used for applying fluids such as paints and coatings as well as more viscous materials such as drywall mud.

A pump with speed control is required. The controls for the pump are remote from pump. The controls communicate with the pump via wires or radio frequency (RF) to regulate pump speed. Quick button presses will incrementally change the flow setting while long button presses will change the settings at a higher rate.

This control method can also be tied to the controls located on the pump. The potentiometer on the pump will set a max setting, and any adjustments at the valve can go below this setting and back up to it, but never exceed it.

It is an advantage of this invention that there is no need to walk back to the pump to set the pump speed.

These and other objects and advantages of the invention will appear more fully from the following description made in conjunction with the accompanying drawings wherein like reference characters refer to the same or similar parts throughout the several views.

BRIEF DESCRIPTION OF DRAWINGS

FIG. 1 shows a cross-section of a dispensing device utilizing the instant invention wired or wirelessly connected to a controlled pump.

BEST MODE FOR CARRYING OUT THE INVENTION

It is an object of this invention, generally 10 to be able to adjust pump 24 speed from a location remote from the pump 24. Such pumps may typically be used for applying paints and coatings as well as more viscous materials such as drywall mud.

A pump 24 with speed control 24*a* is utilized. A dispenser 12 may have a trigger 16 which actuates a valve 16. Dispenser control 18 has "up" and "down" buttons, 20 and 22 respectively. The controls 28 (comprising elements 18, 20 and 22) for the pump 24 are remote from pump 24. The controls communicate with the pump via wires or radio frequency (RF) 26 to regulate pump speed. Quick button (20 and 22) presses will incrementally change the flow setting while long button (20 and 22) presses will change the settings at a higher rate.

This control method can also be tied to speed controls 24*a* located on the pump 24. The potentiometer 30 on the pump 24 will set a max setting, and any adjustments at the valve can go below this setting and back up to it, but never exceed it.

It is an advantage of this invention that there is no need to walk back to the pump to set the pump speed.

It is contemplated that various changes and modifications may be made to the control system without departing from the spirit and scope of the invention as defined by the following claims.

The invention claimed is:

1. A fluid dispensing system comprising:

a pump having a speed control for controlling pump speed;

a dispensing device, comprising:

at least first and second control buttons remote from the pump, and capable of communicating with the speed control of the pump through a wire or radio frequency to adjust pump speed, one of said control buttons actuable to signal the speed control to increase the speed of said pump and the other of said control buttons actuable to decrease the speed of said pump;

a valve connected to the dispensing device; and a trigger for actuating the valve; and a maximum pump speed control potentiometer located on the pump, the maximum pump speed control potentiometer providing a maximum pump speed control setting and allowing the maximum pump speed setting to be adjusted, so that any adjustments of the pump speed by the speed control in response to the first and second control buttons of the dispensing device may adjust the pump speed control to a pump speed setting below or up to the maximum pump speed setting, but may not adjust the pump speed above the maximum pump speed setting.

* * * * *